US007750726B2

(12) United States Patent
Fujisawa et al.

(10) Patent No.: US 7,750,726 B2
(45) Date of Patent: Jul. 6, 2010

(54) REFERENCE VOLTAGE GENERATING CIRCUIT

(75) Inventors: Hiroki Fujisawa, Tokyo (JP); Masayuki Nakamura, Tokyo (JP); Hitoshi Tanaka, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 0 days.

(21) Appl. No.: 12/230,489

(22) Filed: Aug. 29, 2008

(65) Prior Publication Data

US 2009/0002048 A1 Jan. 1, 2009

Related U.S. Application Data

(62) Division of application No. 11/603,121, filed on Nov. 22, 2006, now Pat. No. 7,541,862.

(30) Foreign Application Priority Data

Dec. 8, 2005 (JP) ..... 2005-354872

(51) Int. Cl.
*G05F 3/02* (2006.01)
*G05F 1/10* (2006.01)

(52) U.S. Cl. ..... 327/538; 327/513; 327/542; 327/313; 327/315; 327/316

(58) Field of Classification Search ..... 327/512, 327/513, 538–540, 542; 323/311–317
See application file for complete search history.

(56) References Cited

U.S. PATENT DOCUMENTS

| | | | | |
|---|---|---|---|---|
| 5,619,163 | A | 4/1997 | Koo | |
| 6,885,179 | B1 * | 4/2005 | Ker et al. | 323/316 |
| 7,436,245 | B2 * | 10/2008 | Nguyen | 327/539 |
| 2007/0200546 | A1 * | 8/2007 | Logiudice et al. | 323/316 |

FOREIGN PATENT DOCUMENTS

JP 08-320730 12/1996

OTHER PUBLICATIONS

B. Razavi, "Designing of Analog CMOS Integrated Circuit," pp. 470-471, translated by Tadahiro Kuroda, published by Maruzen Co. Ltd.

* cited by examiner

*Primary Examiner*—Lincoln Donovan
*Assistant Examiner*—Patrick O'Neill
(74) *Attorney, Agent, or Firm*—Foley & Lardner LLP

(57) ABSTRACT

A reference voltage generating circuit includes a current generating section, a voltage generating section, a voltage dividing circuit, and a synthesis section. The current generating section generates a first current having a positive temperature coefficient. The voltage generating section generates a voltage having a negative temperature coefficient. The voltage dividing circuit divides the voltage of the negative temperature coefficient, generated by the voltage generating section. The synthesis section generates a voltage which is the sum of a terminal voltage obtained on causing the first current through a resistor and a voltage obtained on dividing the voltage having the negative temperature coefficient by the voltage dividing circuit, and outputs the sum voltage generated as a reference voltage.

12 Claims, 9 Drawing Sheets

REFERENCE VOLTAGE GENERATING CIRCUIT

CROSS-REFERENCE TO RELATED PATENT APPLICATIONS

This application is a division of application Ser. No. 11/603,121, filed Nov. 22, 2006, now pending, and based on Japanese Patent Application No. 2005-354872, filed Dec. 8, 2005, by Hiroki Fujisawa, Masayuki Nakamura and Hitoshi Tanaka, the disclosures of which are incorporated herein by reference in their entirety. This application claims only subject matter disclosed in the parent application and therefore presents no new matter.

FIELD OF THE INVENTION

This invention relates to a reference voltage generating circuit. More particularly, this invention relates to a reference voltage generating circuit capable of a low voltage operation and less susceptible to manufacturing variations.

BACKGROUND OF THE INVENTION

FIG. 1 shows an exemplary configuration of a conventional band gap reference voltage generating circuit for outputting a reference voltage free from temperature dependency. This circuit is also termed a "Band-Gap-Referenced Biasing Circuit". As for this sort of the circuit, reference is to be made to the description of, for example, Non-Patent publication 1. The reference voltage generating circuit includes PNP bipolar junction transistors (herein abbreviated to BJT transistors) Q1 and Q2, a differential amplifier A1 and resistors R1 and R2.

To an emitter of the BJT Q1, which has a base and a collector connected to the ground potential, is connected one end of the resistor R1, the other end of which is connected to an output of the differential amplifier A1. The resistor R2 has its one end connected to an emitter of the BJT Q2, a base and a collector of which are connected to the ground potential. The resistor R2 has its other end connected to the one end of the resistor R1, the other end of which is connected to an output of the differential amplifier A1. A node N1 between the resistor R1 and the emitter of the BJT Q1 and a node N2 between the resistors R1 and R2 are connected to the non-inverting input terminal and to the inverting input terminal of the differential amplifier A1, respectively. Meanwhile, with the N-well process, it is possible to form a structure operating as a PNP bipolar junction transistor, in which a $P^+$ region in the N-well becomes an emitter, the N-well becomes a base and the P-substrate becomes a collector, which is connected to the ground potential (see Non-Patent Document 1).

The emitter size ratio of the BJTs Q1 and Q2 is such that AE (Q1):AE (Q2)=1:N. An output voltage $V_{REF}$ of the circuit, described above, may be determined by the following method.

The nodes N1 and N2 become equal to each other in potential due to negative feedback of the differential amplifier A1. Hence, the currents flowing through the two resistors R1 become equal to each other, while the currents flowing through the BJTs Q1 and Q2 (collector currents) also become equal to each other.

Since the emitter area of the BJT Q2 is larger than that of the BJT Q1, the base-to-emitter voltage $V_{BE2}$ of the BJT Q2 becomes smaller than the base-to-emitter voltage $V_{BE1}$ of the BJT Q1, and the differential voltage $\Delta V_{BE}$ between the two voltages $V_{BE1}$ and $V_{BE2}$ is applied to the resistor R2. This potential difference $\Delta V_{BE}=V_{BE1}-V_{BE2}$ is given by the following equation (1):

$$\Delta V_{BE} = \frac{kT}{q}\ln N \tag{1}$$

The derivation of the equation (1) will now be briefly described. Since the collector currents $I_1$ and $I_2$ of the BJTs Q1 and Q2 are given respectively by $I_1=I_s\exp(qV_{BE1}/(kT))$ and $I_2=I_s\exp(qV_{BE2}/(kT))$, where $I_s$ denotes the saturation current, k the Boltzmann constant, T the absolute temperature and q denotes the electrical charge of an electron (unit electrical charge), the base-to-emitter voltages of Q1 and Q2 may be expressed as $V_{BE1}=(kT/q)\ln(I_1/I_s)$ and $V_{BE2}=(kT/q)\ln(I_2/I_s)$, respectively. Hence, $$\begin{aligned}\Delta V_{BE} &= V_{BE1} - V_{BE2}\\ &= (kT/q)\ln(I_1/I_s) - (kT/q)\ln(I_2/NI_s))\\ &= (kT/q)\ln(NI_1/I_2)\end{aligned}$$

so that, when $I_1=I_2$, the above equation (1) is derived.

The current $I_2$, flowing through the resistor R2, is given by the following equation (2):

$$I_2 = \frac{\Delta V_{BE}}{R_2} = \frac{kT}{R_2 q}\ln N = I_1 \tag{2}$$

Hence, the output voltage $V_{REF}$ of the differential amplifier A1 is given by the following equation (3):

$$V_{REF} = V_{BE1} + R_1 I_1 = V_{BE1} + \frac{R_1}{R_2}\frac{kT}{q}\ln N \tag{3}$$

In the above equation (3), $V_{REF}$ of the first term has negative temperature dependency, that is, has a negative temperature coefficient, meaning that the higher the temperature, the lower becomes the voltage.

(R1/R2)(kT/q)ln N of the second term is proportionate to the absolute temperature T, that is, the term has positive temperature dependency.

Thus, by suitably adjusting the ratio between the resistances of the resistors R1 and R2, it is possible to cancel out the temperature dependency of the output voltage $V_{REF}$.

The voltage $V_{REF}$ obtained in this manner is termed the 'band-gap voltage' and amounts to 1.2 to 1.3V with the BJT of Si. The currents $I_1$ and $I_2$ are proportionate to the absolute temperature T and hence are termed the proportionate-to-absolute temperature current, abbreviated to PTAT current.

The circuit of this sort is roughly divided into a PTAT current generating section and a reference voltage generating section. In FIG. 1, the resistors R1 and R2 and the BJTs Q1 and Q2 correspond to the PTAT current generating section, while the resistor R1 and the BJT Q1 correspond to the reference voltage generating section. The BJT Q1 is common to the PTAT current generating section and to the reference voltage generating section.

In general, the base-to-emitter voltage $V_{BE}$ suffers from only little process variations. Hence, if the differential amplifier is an ideal amplifier, it is possible to implement a reference voltage having extremely small variations.

However, MOS transistors arranged proximately are in general subjected to variations in the threshold voltage $V_T$ which are as large as several mV to tens of mV. For this reason, with a differential amplifier employing MOS transistors, an offset voltage ascribable to the threshold voltage variations is generated.

This offset voltage summed for the entire circuit and referred as the input voltage of the differential amplifier is the so-called input referred offset voltage. In FIG. 1, $V_{OS}$ denotes the input referred offset voltage.

FIG. 6 is a diagram showing the configuration of a typical example of a differential amplifier formed by MOS transistors. The differential amplifier includes N-channel MOS transistors M1 and M2, which constitute a differential pair, and have sources connected in common, and have gates supplied with voltages $V_{IN}^-$ and $V_{IN}^+$, respectively. The differential amplifier also includes P-channel MOS transistors M3 and M4 of the current mirror configuration, which are connected between a power supply $V_{EXT}$ and the drains of N-channel MOS transistors M1 and M2, and which constitute an active load of the differential pair. The differential amplifier also includes an N-channel MOS transistor M5, which is connected between the coupled sources of the N-channel MOS transistors M1 and M2 and the ground and which constitutes a constant current source. The differential amplifier further includes a P-channel transistor M6, which is connected between the power supply $V_{EXT}$ and an output terminal $V_{OUT}$ and which has a gate connected to a connection node of the drains of the transistors M4 and M2, and an N-channel MOS transistor M7 which is connected between the output terminal $V_{OUT}$ and the ground and which constitutes a constant current source. A bias voltage $V_{BIAS}$ is supplied to the gates of the N-channel MOS transistors M5 and M7.

In this differential amplifier, it is the differential transistor pair M1 and M2 of the input stage that affects, above all, the input referred offset.

The relationship between the offset voltage $V_{OS}$ and the output voltage $V_{REF}$ may be represented by the following equation (4):

$$\left.\frac{dV_{REF}}{dV_{OS}}\right|_{V_{OS}\to 0} = \left.\frac{dV_{BE1}}{dV_{OS}}\right|_{V_{OS}\to 0} + R_1\left.\frac{dI_1}{dV_{OS}}\right|_{V_{OS}\to 0} = 1 + \frac{2}{\ln N} + \frac{R_1}{R_2} + \frac{R_2\left(1+\frac{1}{\ln N}\right)}{R_1 \ln N} > 10 \tag{4}$$

The above solution (4) may be found by differentiating the following two equations (5) and (6) with regard to $V_{OS}$. The equation (5) expresses that, in FIG. 1, the voltage across the terminals of the resistor R2 is equal to the sum of the differential voltage $\Delta V_{BE}$ of the base-to-emitter voltages of the BJTs Q1 and Q2 and the offset voltage $V_{OS}$. The equation (6), on the other hand, expresses that the difference between the voltage at the node N1 and that at the node N2 is equal to the offset voltage $V_{OS}$.

$$I_2R_2 = V_{BE1} - V_{BE2} + V_{OS} = \frac{kT}{q}\ln\frac{NI_1}{I_2} + V_{OS} \tag{5}$$

$$I_1R_1 - V_{OS} = I_2R_1 \tag{6}$$

It is seen from the above equation (4) that, in the circuit configuration of FIG. 1, the offset voltage $V_{OS}$ is multiplied by 10 or more and the so multiplied voltage is output as an output of the differential amplifier A1.

The voltage of this magnitude is non-negligible even in normal applications. It is therefore necessary to trim the resistor R1 or R2 with a laser trimming equipment or an electrical fuse.

On the other hand, in the circuit configuration of FIG. 1, the output voltage $V_{REF}$ is 1.2V to 1.3V. Thus, the voltage at least 1.3V or higher is needed as the power supply $V_{EXT}$, as shown in FIG. 7. Meanwhile, FIG. 7 shows the relationship between the output voltage $V_{OUT}$ ($V_{REF}$) on the vertical axis and the power supply voltage $V_{EXT}$ on the horizontal axis, for the conventional circuit and the present invention as later described.

FIG. 2 shows the circuit configuration disclosed in Patent Document 1 (JP Patent Kokai Publication No. JP-A-8-320730). Referring to FIG. 2, an NPN BJT Q1 has an emitter directly connected to the ground potential, that is, grounded, while an NPN BJT Q2 has an emitter connected via resistor R2 to the ground potential. The collectors of the BJTs Q1 and Q2 are connected to the non-inverting input terminal (+) and to the inverting input terminal (−) of the differential amplifier A1, respectively. One ends of three resistors R0, R0 and R1 are connected in common to an output terminal of the differential amplifier A1, while the other ends of the resistors R0 and R0 are connected to the collectors of the BJTs Q1 and Q2 and the other end of the resistor R1 is connected to the collector and the base of the NPN BJT Q3. A resistor R3 is connected between the base of the BJT Q1 and the base of the BJT Q2. The ratio of the emitter sizes of the BJTs Q1 and Q2 is set to 1:N, where N is a preset positive integer. In this configuration, a resistor R2 for generating $\Delta V_{BE}$ is connected to the emitter of the NPN BJT and feedback to the differential amplifier A1 is via collector terminal of the NPN BJT.

In the reference voltage generating circuit of FIG. 2, the PTAT current generating section for generating the PTAT current, is made up of the resistors R0, R2 and R3, and BJTs Q1 and Q2. The reference voltage generating section for generating the voltage having the negative temperature coefficient, is made up of the resistor R1 and the BJT Q3.

As may be seen from equations (8), (9) and (10), which will be explained later, the collector currents $I_1$, $I_2$ and $I_3$ of the BJTs Q1, Q2 and Q3 are of values proportional to one another, and are all PTAT currents. The output voltage $V_{REF}$ of this circuit is the sum of the base-to-emitter voltage $V_{BE3}$ of the transistor Q3 and the voltage across the terminals of the resistor R1, or $R_1 \cdot I_3$, and may be represented by the following equation (7):

$$V_{REF} = V_{BE3} + R_1 I_3 \tag{7}$$

Since the base-to-emitter voltage $V_{BE3}$ of the transistor Q3 exhibits negative temperature dependency, that is, has a negative temperature coefficient, and the current $I_3$ exhibits positive temperature dependency, that is, has a positive temperature coefficient, a band gap voltage having temperature dependency cancelled out, may be obtained by adjusting appropriately the resistance of the resistor R1, as in the circuit of FIG. 1.

[Patent Document 1]

JP Patent Kokai Publication No. JP-A-8-320730

[Non-Patent Document 1]

Behzad Razavi, "Designing of Analog CMOS Integrated Circuit", pages 470-471, FIG. 11.11, translated by Tadahiro Kuroda, published by Maruzen Co. Ltd.

SUMMARY OF THE DISCLOSURE

With the configuration of FIG. 2, an output error of the MOS transistors of the differential amplifier due to offset may be reduced significantly. This point has not been described in the Patent Document 1 and has been uniquely found out by the present inventors. The results of the analyses by the present inventors will now be described.

The relationship between the offset voltage $V_{OS}$ and the output $V_{REF}$ in FIG. 2 may be represented by the following equation (8):

$$R_0 I_1 - R_0 I_2 = V_{OS} \tag{8}$$

Assuming that the base-to-emitter voltage and the emitter current of the BJT Q2 are $V_{BE2}$ and $I_2$, the base voltage is given by $V_{BE2}+R2\cdot I_2'$. With the common base current amplification factor $\alpha$ of the BJT Q2 where $I_2=\alpha I_2'$, the base current $I_B$ of the BJT Q2 is given by $(1-\alpha)\ I_2/\alpha$. Assuming that the base-to-emitter voltage of the BJT Q1 is $V_{BE1}$, the base voltage of the BJT Q2 is given by $V_{BE1}+R3\cdot I_B$. Thus, the following equation (9):

$$\begin{aligned} R_2 I_2' &= R_2 \frac{I_2}{\alpha} \\ &= (V_{BE1} - V_{BE2}) - \frac{(1-\alpha)I_1}{\alpha} 2R_2 \\ &= \frac{kT}{q} \ln \frac{NI_1}{I_2} - \frac{(1-\alpha)I_1}{\alpha} 2R_2 \\ \therefore I_2 &= \frac{\alpha}{R_2} \frac{kT}{q} \ln \frac{NI_1}{I_2} - 2(1-\alpha)I_1 \end{aligned} \tag{9}$$

may be derived from $V_{BE2}+Re.I_2'=V_{BE1}+R3.(1-\alpha)\ I_2/\alpha$ and R3=2R2.

Moreover, since the current $I_3$ flowing through the resistor R1 is the sum of the collector current $I_1$ of the BJT Q3 and the base currents $I_B$ of the three BJTs Q1, Q2 and Q3, the following equation (10):

$$I_3 = I_1 + 3I_B = I_1 + 3\left(\frac{1-\alpha}{\alpha} I_1\right) = \frac{3-2\alpha}{\alpha} I_1 \tag{10}$$

holds.

Hence, the output voltage $V_{REF}$ may be represented by the following equation (11):

$$V_{REF} = V_{BE3} + R_1 I_3 = V_{BE1} + R_1 \frac{3-2\alpha}{\alpha} I_1 \tag{11}$$

If now the equations (8) and (9) are differentiated with regard to the offset voltage $V_{OS}$ and, using the equations (10) and (11), $dV_{REF}/dV_{OS}$ with $V_{OS}$->0 is found, the following equation (12) is derived.

$$\begin{aligned} \frac{dV_{REF}}{dV_{OS}}\Big|_{V_{OS}\to 0} &= \frac{dV_{BE1}}{dV_{OS}}\Big|_{V_{OS}\to 0} + \frac{3-2\alpha}{\alpha} R_1 \frac{dI_1}{dV_{OS}}\Big|_{V_{OS}\to 0} \\ &= \frac{\left(\frac{R_2}{\ln N} + \frac{3-2\alpha}{\alpha} R_1\right)}{R_0\left[1 - \frac{\ln N}{\ln N + \alpha}\left\{\frac{\alpha}{\ln N} - 2(1-\alpha)\right\}\right]} \approx 1 \sim 2 \end{aligned} \tag{12}$$

It is noted that $\alpha$ is the common base current amplification factor of the BJTs Q1 and Q2 ($\alpha<1$). Calculations on the equation (12) yield the value of 1 to 2 as $dV_{REF}/dV_{OS}$. Hence, with the circuit configuration of FIG. 2, the offset voltage $V_{OS}$ appears as it is multiplied by a factor of 1 or 2 as an output voltage.

This value is sufficiently small as compared to that of the configuration of FIG. 1 in which the offset voltage $V_{OS}$ appears as it is multiplied by a factor of 10 or more as an output voltage. This small multiplication factor in the circuit configuration of FIG. 2 may be said to be qualitatively attributable to the operation of amplification by the BJTs Q1 and Q2 and the two resistors R0.

That is, if the output voltage $V_{REF}$ is changed, the change is represented through resistor R1 as the change in the base potential and the collector potential of the BJT Q3.

The change in the base potential of the BJT Q3 is represented as the change in the base currents of the BJTs Q1 and Q2. This current change is amplified by the BJTs Q1 and Q2 and by the two resistors R0 to be applied to the respective collectors (nodes N1 and N2) so as to be supplied as input to the differential amplifier A1. The unbalanced between the nodes N1 and N2, ascribable to the offset voltage $V_{OS}$, may be corrected by a change in the output voltage $V_{REF}$ which is smaller than in the configuration of FIG. 1 by an amount the current change is amplified as described above.

Since the offset voltage of the differential amplifier is several mV to tens of mV, as described above, the error of the order of the magnitude described above may be substantially negligible in a memory or in an application as an internal power supply. That is, trimming is not required.

However, in the circuit configuration of FIG. 2, the output voltage is 1.2V to 1.3V, as in the circuit configuration of FIG. 1. Consequently, the power supply voltage not less than 1.3V is required.

Recently, the LSI operating at a voltage 1.5V or lower has become common. With this in mind, it is necessary to provide a reference voltage down to approximately 1V so as to secure an operation margin.

If MOS transistors are used as components of the reference voltage generating circuit, in the circuit configuration of FIG. 1, there is raised the problem related with the increased variations in the output voltage, as described above.

Moreover, in the reference voltage generating circuit of FIG. 2, as a constitution for overcoming the above problem, the output voltage is of the order of 1.2V, so that, in order for the reference voltage generating circuit to be in operation, the power supply voltage equal to or higher than 1.3V is needed, thus raising another problem.

Accordingly, it is an object of the present invention to provide a reference voltage generating circuit which is less susceptible to variations and which has a low voltage for staring operation.

The above and other objects are attained by the present invention which has substantially the following constitution.

A reference voltage generating circuit in accordance with one aspect of the present invention, comprises:

a current generating section that generates a first current having a positive temperature coefficient;

a voltage generating section that generates a voltage having a negative temperature coefficient;

a synthesis section that generates a voltage which is the sum of a voltage having a positive temperature coefficient and developed across both terminals of a resistor by causing a current having a positive temperature coefficient to flow through said resistor, and said voltage having a negative temperature coefficient; and a compensation current generating section that generates a second current having a positive temperature coefficient;

a current corresponding to the sum of said first and second currents being caused to flow through said resistor;

said synthesis section generating a voltage which is a sum of a terminal voltage of said resistor by the sum current of said first and second currents and said voltage having a negative temperature coefficient; said synthesis section outputting the voltage generated as a reference voltage.

According to the present invention, preferably the compensation current generating section outputs, as the second current, a current proportional to a differential voltage corresponding to subtraction of the voltage having the negative temperature coefficient from the output reference voltage. According to the present invention, the temperature coefficient of the second current may be set so as to be larger than that of the first current.

According to the present invention, the synthesis section comprises a differential amplifier. The current generating section may include a first resistor having one end connected to an output terminal of the differential amplifier, a first transistor having a collector connected to the other end of the first resistor and having an emitter connected to the ground potential, a second resistor having one end connected to an output terminal of the differential amplifier, and a second transistor having a collector connected to the other end of the second resistor and having an emitter connected via a third resistor to the ground potential. The voltage generating section may include a fourth resistor having one end connected to the output terminal of the differential amplifier, and a third transistor having a collector and a base connected to the other end of the fourth resistor and having an emitter connected to the ground potential. The second transistor has a base connected via a fifth resistor to the base of the first transistor. The third transistor has a collector and a base connected to the base of the first transistor. The collectors of the first and second transistors are connected to a non-inverting input terminal and an inverting input terminal of the differential amplifier, respectively. The compensation current generating section may include a sixth resistor having one end connected to the output terminal of the differential amplifier, a fourth transistor having a collector connected to the other end of the fourth resistor and having an emitter connected to the ground potential, and a fifth transistor having an emitter connected to the ground potential, having a collector and a base connected in common to the other end of the sixth resistor and having the collector and the base connected to the base of the fourth transistor.

A reference voltage generating circuit in accordance with another aspect of the present invention comprises:

a current generating section that generates a first current having a positive temperature coefficient;

a voltage generating section that generates a voltage having a negative temperature coefficient;

a voltage dividing circuit that divides said voltage of the negative temperature coefficient, generated by said voltage generating section; and a synthesis section that generates a voltage which is the sum of a terminal voltage obtained on causing said first current through a resistor and a voltage obtained on dividing said voltage having the negative temperature coefficient by said voltage dividing circuit, and for outputting the sum voltage generated as a reference voltage.

According to the present invention, the synthesis section is formed by a differential amplifier. The current generating section may include a first resistor having one end connected to an output terminal of the differential amplifier, a first transistor having a collector connected to the other end of the first resistor and having an emitter connected to the ground potential, a second resistor having one end connected to an output terminal of the differential amplifier, and a second transistor having a collector connected to the other end of the second resistor and having an emitter connected via third resistor to the ground potential. The voltage generating section may include a fourth resistor having one end connected to the output terminal of the differential amplifier, and a third transistor having a collector connected to the other end of the fourth resistor and having an emitter connected to the ground potential.

There is provided another differential amplifier having a non-inverting input terminal and an inverting input terminal connected to connection nodes of the first and second resistors and to the collectors of the first and second transistors, respectively. The other differential amplifier has an output terminal connected to a base of the third transistor. The bases of the first to third transistors are formed as a common base. There is provided a voltage dividing circuit made up of plural resistors connected in series between the common base of the first to third transistors and the ground. An output voltage obtained on voltage division by the voltage dividing circuit is supplied to a non-inverting input terminal of the differential amplifier. A connection node of the fourth resistor and the collector of the third transistor is connected to an inverting input terminal of the differential amplifier.

According to the present invention, the ratio of the emitter sizes of the first and second transistors in the current generating section is 1:N, where N is an integer greater than 1. The voltage having the negative temperature coefficient corresponds to the base-to-emitter voltage of a bipolar transistor.

According to the present invention, the first current with the positive temperature coefficient is the current proportional to a thermal voltage ($=kT/q$, where k is the Boltzmann constant, T is an absolute temperature and q is the electric charge of an electron).

A reference voltage generating circuit in accordance with a further aspect of the present invention includes:

first, second and third resistors, a first differential amplifier and first, second and third bipolar junction transistors;

said first and second bipolar junction transistors having collectors connected to first and second input terminals of said first differential amplifier;

said first, second and third resistors having one ends connected in common to said output terminal of said first differential amplifier;

said first resistor having the other end connected to the collector of said first bipolar junction transistor;

said second resistor having the other end connected to the collector of said second bipolar junction transistor;

said third resistor having the other end connected to the collector and the base of said third bipolar junction transistor;

said third bipolar junction transistor having a base connected to the bases of said first and second bipolar junction transistors;

the ratio of the emitter sizes of said first and second bipolar junction transistors being set to 1:N, where N is an integer greater than 1;

said reference voltage generating circuit comprising a compensation current generating section that generates the current having a positive temperature coefficient larger than a temperature coefficient of said first bipolar junction transistor or said second bipolar junction transistor;

a current equal to the collector current of said first bipolar junction transistor or said second bipolar junction transistor and a current with a positive temperature coefficient larger than a temperature coefficient of said current equal to said collector current being added and the resulting current being caused to flow through said third resistor;

a voltage equal to the sum of the voltage across the terminals of said third resistor and the base-to-emitter voltage of said third bipolar junction transistor being output from said first differential amplifier.

In the present invention, said compensation current generating section includes:

a fourth transistor having an emitter connected to the ground potential, having a collector connected via a fourth resistor to an output terminal of said first differential amplifier and having a base connected to the collector; and a fifth transistor having an emitter connected to the ground potential, having a collector connected via a fourth resistor to the collector of said third transistor and having a base connected to a base of said fourth transistor.

In the present invention, the ratio of the emitter sizes of said first and second transistors is 1:N, where N is an integer greater than 1.

A reference voltage generating circuit in accordance with a further aspect of the present invention includes first, second and third resistors, a first differential amplifier and first, second and third transistors (bipolar junction transistors). The collector terminal of the first transistor is connected to a first input terminal of the first differential amplifier. The collector terminal of the second transistor is connected to a second input terminal of the second differential amplifier. One ends of the first, second and third resistors are connected in common to the output terminal of the first differential amplifier. The first resistor has the other end connected to the collector of the first transistor, the second resistor having the other end connected to the collector of the second transistor and the third resistor having the other end connected to the collector and the base of the third transistor. The third transistor has a base connected to the bases of the first and second transistors. The ratio of the emitter sizes of the first and second transistors is set to 1:N. A current approximately equal to the collector current of the first transistor or the second transistor and a current having a positive temperature coefficient larger than a temperature coefficient of the collector current are added and the resulting current is caused to flow through the third resistor. A voltage equal to the sum of the voltage generated across the terminals of the third resistor and the base-to-emitter voltage of the third transistor is output from the first differential amplifier.

A reference voltage generating circuit in accordance with a further aspect of the present invention includes at least a first resistor, a first differential amplifier and first, second and third transistors (bipolar junction transistors). The first transistor has a collector connected to a first input terminal of the first differential amplifier. The second transistor has a collector connected to a second input terminal of the first differential amplifier. The bases of the first and second transistors are connected to the output of the first differential amplifier. The ratio of the emitter sizes of the first and second transistors is set to 1:N. The first differential amplifier may output a voltage equal to the sum of a voltage obtained on dividing the base-to-emitter voltage of the first transistor and a voltage obtained on causing a current equal or proportional to the collector current of the first transistor or the second transistor to flow through the first resistor.

In a further aspect, the present invention provides a reference voltage generating circuit including a first transistor, a second transistor, a differential amplifier and second and third resistors. The first transistor has a first terminal connected to the ground potential, while having a control terminal and a second terminal connected together. The second transistor has a first terminal connected via a first terminal to the ground potential, while having a control terminal connected in common to a second terminal and a control terminal of the first transistor. The differential amplifier has a differential input pair connected to a second terminal of the first transistor and to a second terminal of the second transistor. The second and third resistors have one ends connected to second terminals of the first and second transistors, while having the other ends connected in common to the output terminal of the differential amplifier.

In yet another aspect, the present invention provides a circuit preferably including first, second and third resistors, first and second MOS transistors, having a channel width ratio of 1:N, and a first differential amplifier. One ends of the first and second resistors are connected to an output of the differential amplifier. The other end of the first resistor is connected to the drain and the gate of the first MOS transistor and to the first input terminal of the first differential amplifier. The other end of the second resistor is connected to the drain of the second MOS transistor and to the second input terminal of the first differential amplifier. The third resistor has one end connected to the source of the second MOS transistor, while having the other end connected to the ground potential. The threshold voltage of the first and second MOS transistors may be set so as to be lower than the base-to-emitter voltage of a BJT and outputting may be from an output terminal of the first differential amplifier.

The meritorious effects of the present invention are summarized as follows.

According to the present invention, temperature dependency may be canceled, at a voltage lower than 1.2V, as low voltage dependency of the first differential amplifier is maintained. Hence, there may be provided a reference voltage generating circuit suffering from variations only to a lesser extent and which exhibits only low temperature dependency.

Still other features and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF THE INVENTION

Figure 3:
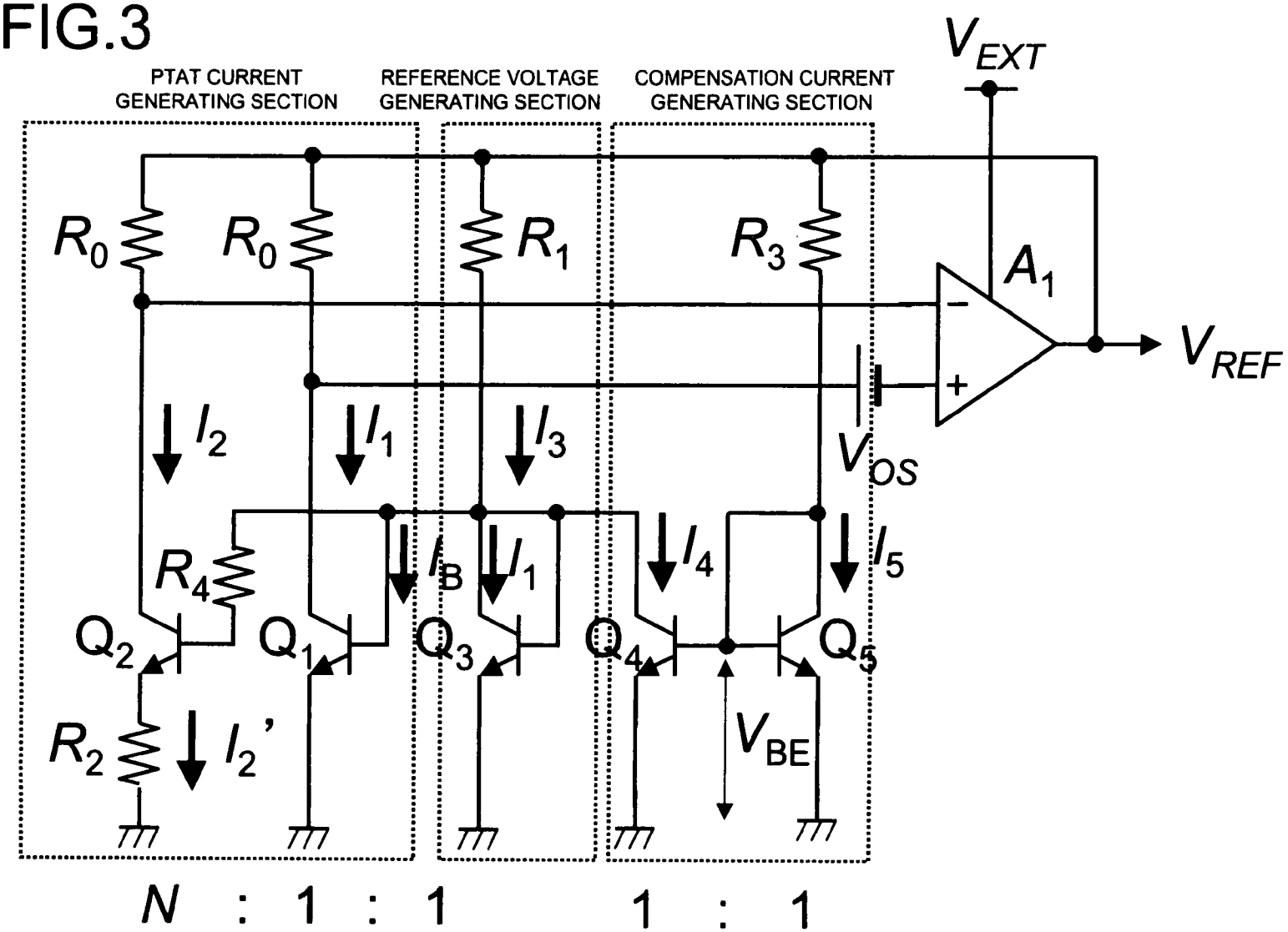
FIG. 3 is a circuit diagram showing the configuration of a first embodiment of the present invention.

The present invention will be described in further detail with reference to the accompanying drawings. Referring first to FIG. 3, the present invention includes a PTAT current generating section (BJTs Q1 and Q2 and resistors R0, R0, R2 and R4), that generates a first current ($I_1$) having a positive temperature coefficient, a reference voltage generating section (BJT Q3 and resistor R1) that generates a voltage ($V_{BE3}$) having a negative temperature coefficient, a synthesis section (differential amplifier A1) that generates a sum voltage of a terminal voltage of the resistor (R1) and the voltage ($V_{BE3}$) having the negative temperature coefficient, and a compensation current generating section (Q4, Q5 and resistor R3) that generates a second current having a positive temperature coefficient. The emitter size ratio of the BJTs Q1 and Q2 of the PTAT current generating section is set to 1:N. A synthesis current (sum current) ($I_3$), which is the sum of the second current ($I_4$) and the first current ($I_1$), is caused to flow through the resistor (R1). The synthesis section (A1) outputs, as a reference voltage $V_{REF}$, a voltage obtained by synthesizing the terminal voltage of the resistor (R1), through which the sum current of the first current ($I_1$) and the second current ($I_4$) flows, and the voltage ($V_{BE3}$) having the negative temperature coefficient. The compensation current generating section comprises a current mirror that outputs, as the second current ($I_4$), the current proportional to the differential voltage corresponding to the output voltage ($V_{REF}$) from the synthesis section (A1) subtracted by the voltage having the negative temperature coefficient (base-to-emitter voltage $V_{BE}$ of Q5).

According to the present invention, the current of a value approximately equal to that of the collector current ($I_1$ or $I_2$) of the transistor (Q1 or Q2) is added with the current ($I_4$) having the temperature coefficient greater than that of the collector current, and the resulting sum current is caused to flow through the resistor (R1). The voltage corresponding to the terminal voltage of the resistor (R1) and the base-to-emitter voltage ($V_{BE3}$) of the transistor (Q3) is output.

With this configuration, the temperature dependency may be compensated, at a voltage lower than 1.2V, as offset voltage dependency of the differential amplifier (A1) is kept low, and hence a reference voltage generating circuit may be provided which has small variations and low temperature dependency.

Figure 4:
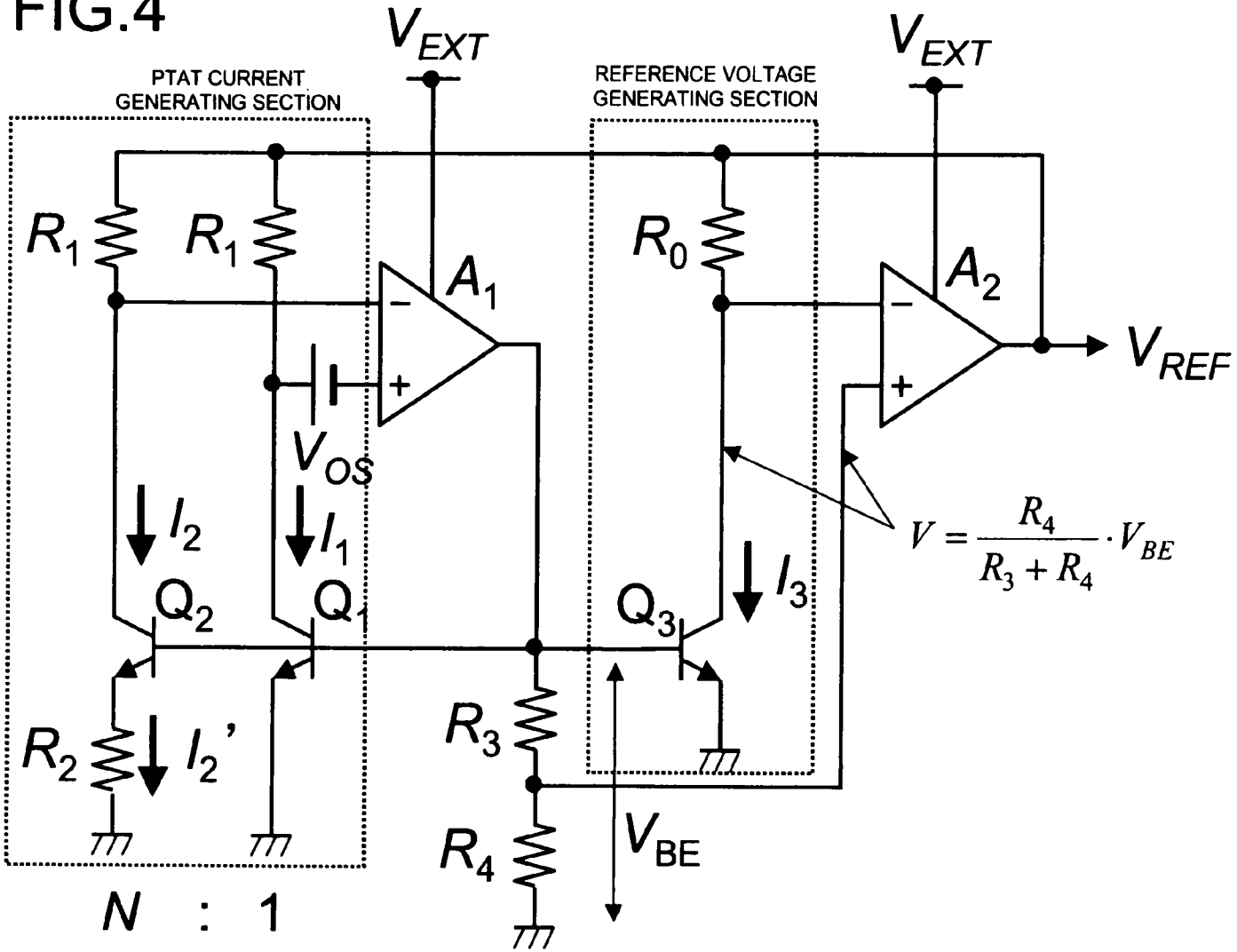
FIG. 4 is a circuit diagram showing the configuration of a second embodiment of the present invention.

Referring first to FIG. 4, another embodiment of the present invention includes a PTAT current generating section (BJTs Q1 and Q2 and resistors R1, R1, and R2), that generates a first current having a positive temperature coefficient, and a reference voltage generating section (BJT Q3 and resistor R0) that generates a voltage having a negative temperature coefficient. The present embodiment also includes a voltage dividing circuit (R3 and R4) that divides the voltage of the negative temperature coefficient, generated by the reference voltage generating section, and a synthesis section (differential amplifier A2) that generates and outputting a sum voltage corresponding to the sum of the terminal voltage obtained on causing the first current to flow through a resistor and a voltage obtained on voltage-dividing the voltage ($V_{BE}$) of the negative temperature coefficient by the voltage dividing circuit (R3 and R4). The emitter size ratio of the BJTs Q1 and Q2 of the PTAT current generating section is set to 1:N. There is also provided a differential amplifier (A2) having its non-inverting input terminal connected to a connection node of the collector of the BJT Q1 and the resistor R1, having its inverting input terminal connected to a connection node of the collector of the BJT Q1 and the resistor R1 and having its output terminal connected to the base of the BJT Q3. The bases of the BJTs Q1, Q2 and Q3 form a common base. The differential amplifier (A2) has a non-inverting input terminal connected to the output terminal of the voltage dividing circuit (R3 and R4), while having an inverting input terminal connected to a connection node between the BJT Q3 and the resistor R0. By outputting a sum voltage corresponding to the sum of a voltage obtained on voltage-dividing the base-to-emitter voltage of the BJT Q1 ($=V_{BE}$) of the BJT Q1 ($=\{R4/(R3+R4)\}V_{BE}$) and a voltage obtained on causing a current approximately equal to the collector current ($I_1$ or $I_2$) of the BJTs Q1 and Q2 to flow through the resistor (R0), the temperature dependency may be canceled out at a voltage lower than 1.2V as the offset voltage dependency of the described above (A1) is kept at a low level. Thus, according to the modified embodiment of the present invention, a reference voltage generating circuit with small variations and small temperature dependency may be provided.

Figure 5:
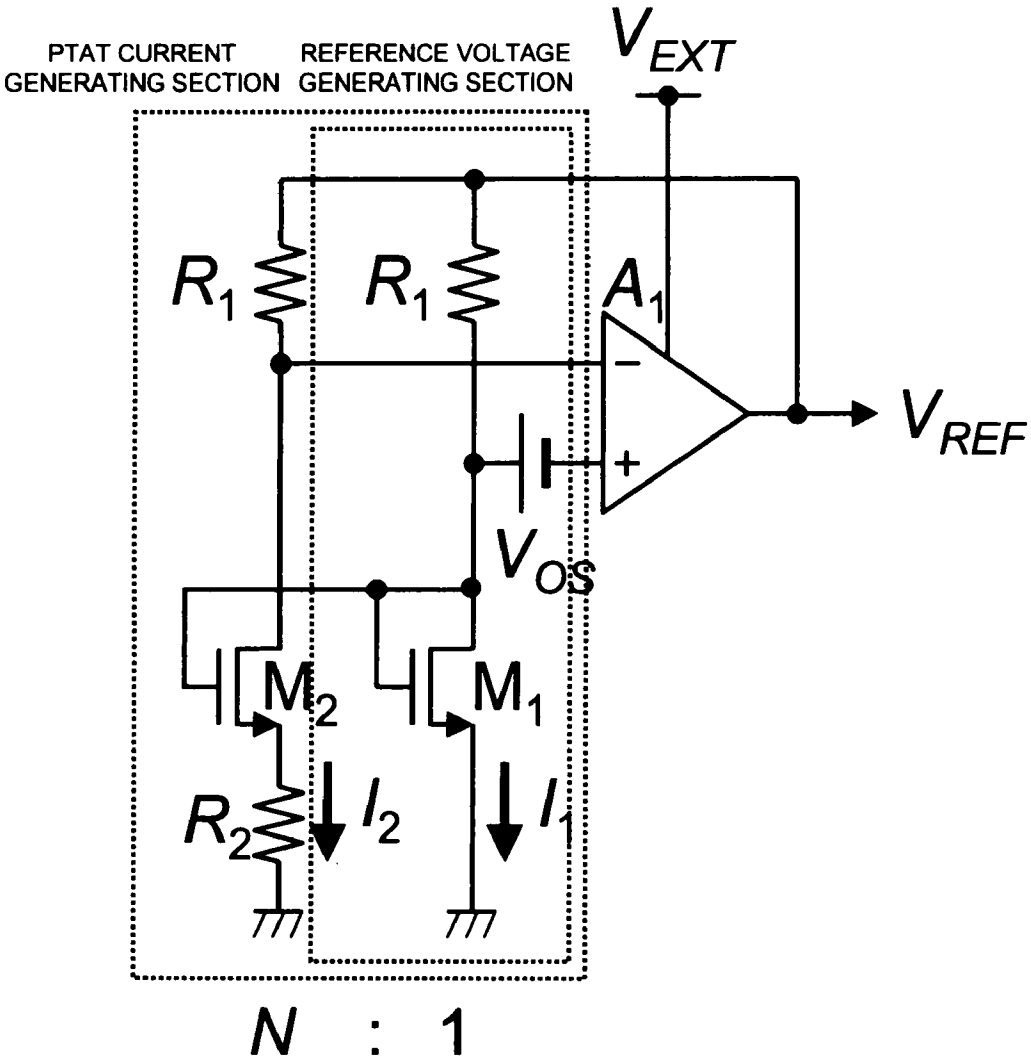
FIG. 5 is a circuit diagram showing the configuration of a third embodiment of the present invention.
Figure 6:
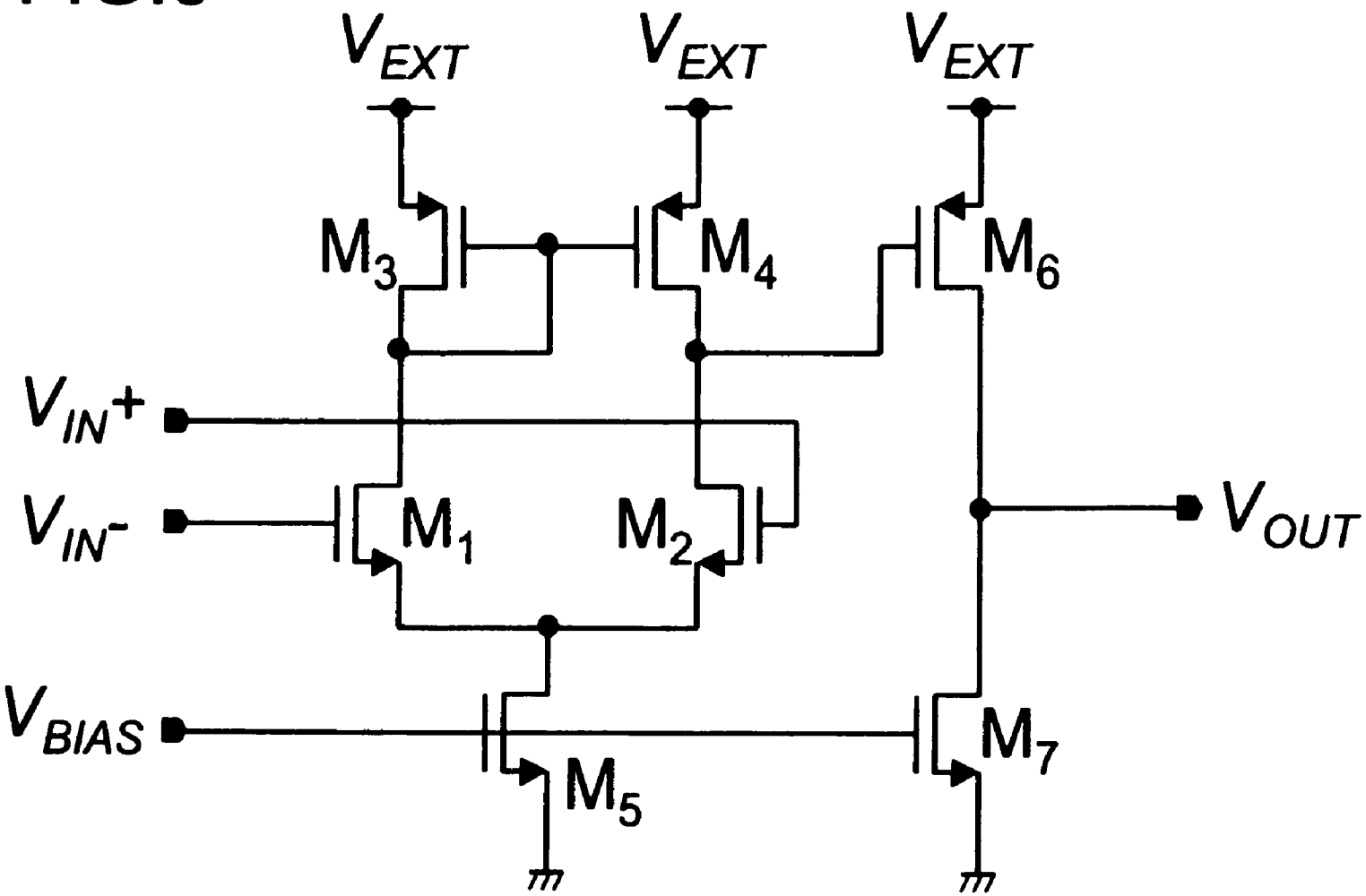
FIG.6 RELATED ART
FIG. 6 is a circuit diagram showing an embodiment of a differential amplifier used in the present invention.

Referring first to FIG. 5, yet another embodiment of the present invention includes a first transistor (M1), a second transistor (M2), a differential amplifier (A1) and second and third resistors (R1 and R1). The first transistor has a first terminal connected to the ground potential, while having a control terminal and a second terminal connected together. The second transistor has a first terminal connected to the ground potential via first resistor (R2), while having a control terminal connected in common to the second terminal and the control terminal of the first transistor. The differential amplifier (A1) has its differential pair connected to a second terminal of the first transistor and to a second terminal of the second transistor. The one ends of the second and third resistors (R1, R1) are connected to the second terminals of the first and second transistors (M1 and M2), while the other ends thereof are connected in common to the output end of the differential amplifier (A1). The first and second transistors (M1 and M2) are formed by MOS transistors, while the ratio of the channel widths (W) thereof is set to 1:N. By setting the threshold voltage of the first and second MOS transistors so as to be lower than the base-to-emitter voltage of the BJT, and output at an output terminal of the first differential amplifier, the temperature dependency may be canceled out at a voltage lower than 1.2V, as the offset voltage dependency of the first differential amplifier is kept at a low level. Hence, a reference voltage generating circuit with small variations and small temperature dependency may be produced. In the present embodiment, the first and second transistors may be BJTs with the emitter size ratio of 1:N. The present invention will now be described with reference to exemplary examples.

FIG. 3 shows the configuration of a first embodiment of the present invention. In the present embodiment, as contrasted to the circuit shown in FIG. 2, the resistance value of the resistor R1 is set so as to be smaller so that the output voltage $V_{REF}$ less than the band-gap voltage. There is newly provided a compensation current generating section that generates the current having a positive temperature coefficient greater than a temperature coefficient of the PTAT current. The current generated by the compensation current generating section is synthesized with the PTAT current and the resulting synthesized current is caused to flow through the resistor R1.

More specifically, referring to FIG. 3, the compensation current generating section in the reference voltage generating circuit of the present embodiment includes a BJT Q4 and a BJT Q5. The BJT Q4 has a collector connected to a connection node of a resistor R1 and the base and the collector of the BJT Q3, while having an emitter connected to the ground potential. The BJT Q5 has an emitter connected to the ground potential, while having the collector and the base connected via resistor R3 to an output of the differential amplifier A1. The bases of the BJTs Q4 and Q5 are connected in common, so that the BJTs Q4 and Q5 constitute a current mirror.

Figure 2:
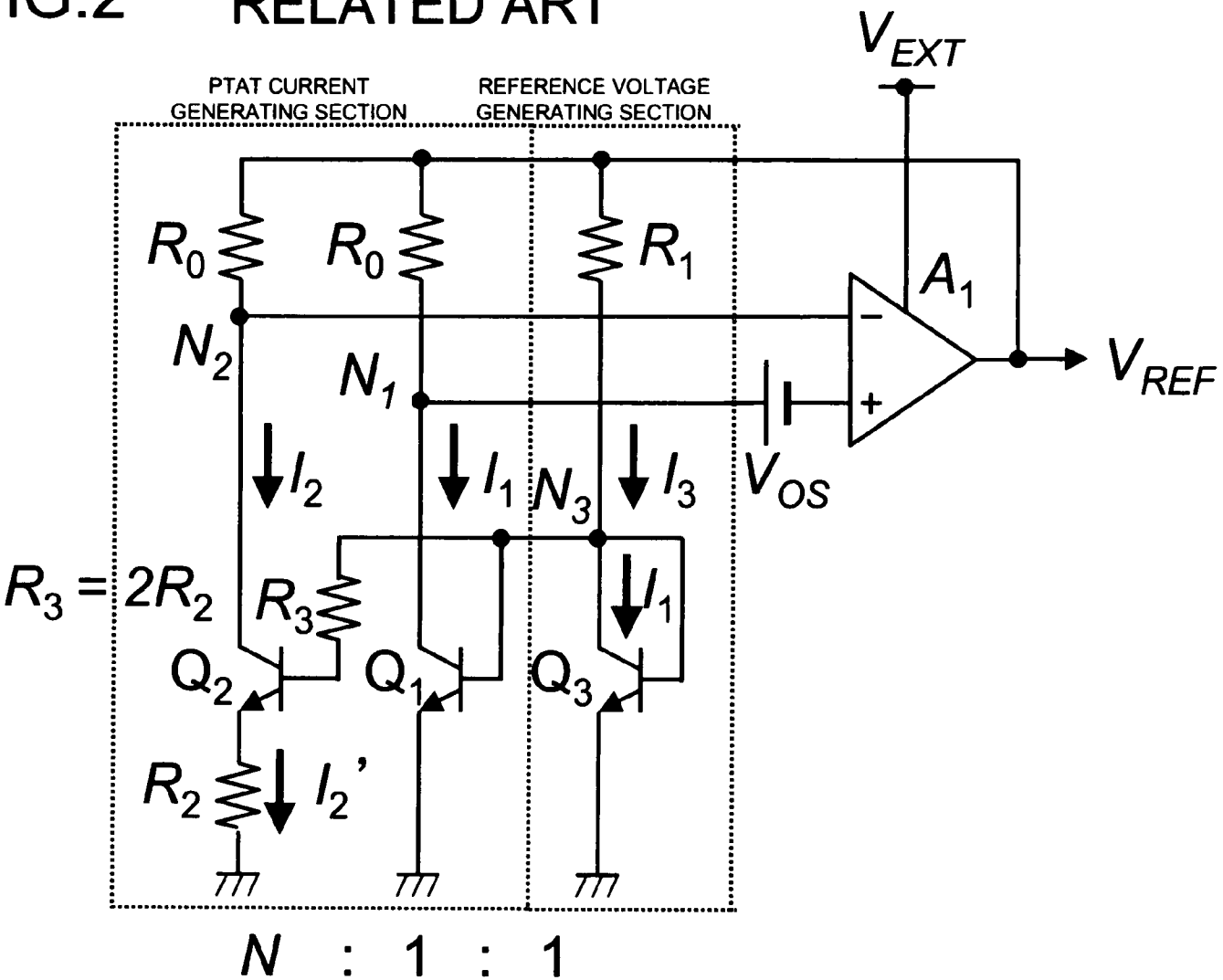
FIG.2 RELATED ART
FIG. 2 is a circuit diagram showing another example of the configuration of a conventional reference voltage circuit.

Referring to FIG. 3, the PTAT current generating section in the present embodiment is configured similarly to the configuration of FIG. 2, and includes a resistor R0, having one end connected to the output of the differential amplifier A1, and a BJT Q1, having a collector connected to the other end of the resistor R0 and having an emitter connected to the ground potential. The PTAT current generating section also includes another resistor R0, having one end connected to the output of the differential amplifier A1, and a BJT Q2, having a collector connected to the other end of the other resistor R0 and having an emitter connected to the ground potential via a resistor R2. The ratio of the emitter sizes of the BJTs Q1 and Q2 is set to 1:N.

The reference voltage generating section includes a resistor R1, having one end connected to the output of the differential amplifier A1, and a BJT Q3, having a collector and a base connected to the other end of the resistor R1 and having an emitter connected to the ground potential. The base of the BJT Q2 is connected via resistor R4 to the base of the BJT Q1, while the base and the collector of the BJT Q3 is connected to the base of the BJT Q1.

Figure 7:
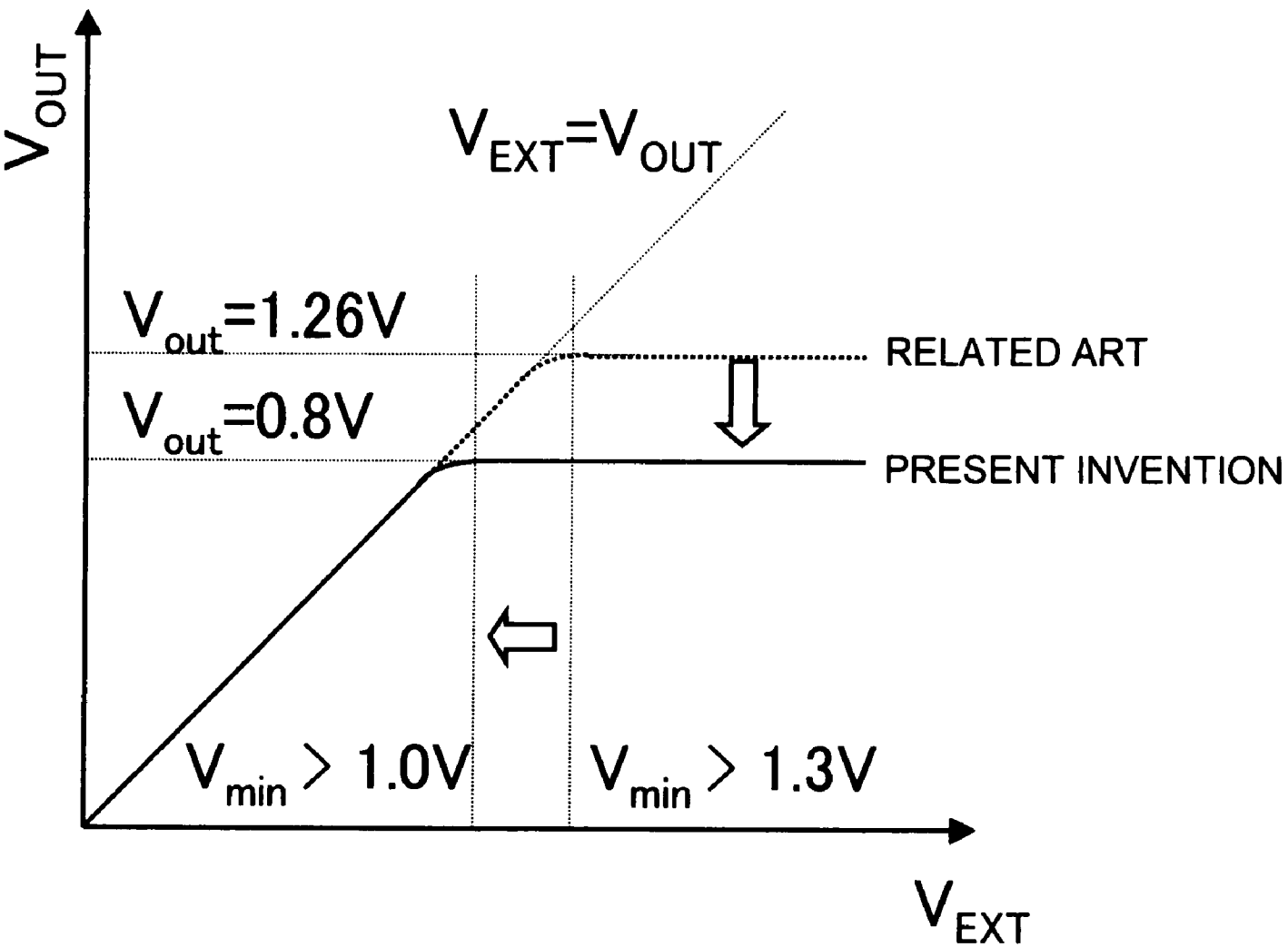
FIG. 7 is a graph showing the relationship between the output voltage of a reference voltage circuit and an external voltage according to the present invention and that of the related art.

By this configuration, temperature dependency may be canceled out at a voltage lower than the band-gap voltage (1.2V) of the related art, as the offset voltage dependency ($V_{OS}$ dependency) of the differential amplifier is maintained at a smaller value. FIG. 7 shows the relationship between the output voltage and the external voltage according to the present invention and that of the related art. It is noted that the output voltage ($V_{OUT}$) of the ordinate corresponds to the output reference voltage $V_{REF}$. This output voltage is 1.26V in the related art, for example. According to the present invention, an output voltage lower than that in the related art may be output as the temperature dependency of the output voltage ($V_{OUT}$) is canceled and as the offset voltage dependency of the differential amplifier is reduced.

A current $I_5$, having a positive temperature coefficient larger than a temperature coefficient of the PTAT current, is generated by the resistor R3 and the BJT Q5. The resistor R3 has one end connected to the output terminal of the differential amplifier A1, while having the other end connected to the base and the collector of the BJT Q5, an emitter of which is connected to the ground potential.

The collector of the BJT Q4 is connected to the connection node between the collector of the BJT Q3 and the resistor R1, while the base of the BJT Q4 is connected to the collector and the base of the BJT Q5, whereby the current mirror is formed, so that a current $I_4$ proportionate to (herein equal to) the current $I_5$ is caused to flow through the resistor R1.

The input current $I_5$ of the current mirror circuit (Q4 and Q5), that is, the collector current of the BJT Q5, may be represented by the following equation (13):

$$I_5 = \frac{(V_{REF} - V_{BE})}{R_3} = I_4 \tag{13}$$

Supposing that, in the output voltage (reference voltage) $V_{REF}$, the temperature environment has been canceled, and the temperature coefficient is zero, the temperature dependency of the current $I_5$ is determined by the negative polarity—$V_{BE}$ of the base-to-emitter voltage of the transistor Q5.

On the other hand, the difference in the base-to-emitter voltage $V_{BE}$ of the BJTs Q1 and Q2 for generating the PTAT current may be represented by the above equation (1).

The temperature dependency of $V_{BE}$ is −2 mV/°C., while $\Delta V_{BE}$ is +0.2 mV/°C., for N=10, so that the temperature dependency is higher by as much as ten times.

The temperature coefficient (positive characteristics) of the output current $I_4$ of the compensation current generating section is larger than that of the PTAT current $I_1$ which is based on the voltage difference of the base-to-emitter voltages of the BJTs Q1 and Q2.

Thus, by causing the output current $I_4$ of the compensation current generating section to flow through the resistor R1 as well, the temperature dependency of the output voltage may be canceled with a resistance value of the resistor R1 which is smaller than in the case of the configuration of FIG. 2. As regards the voltage across the terminals of the resistor R1, the temperature dependency of the current $I_3$ through the resistor R1 corresponds to that of the added current (sum current) of the PTAT current $I_1$ and the output current $I_4$ of the compensation current generating section. That is, the value of the temperature coefficient becomes effectively larger.

It is noted that, from the equation (7), the output voltage $V_{REF}$ is given by the following equation (14):

$$V_{REF}=R_1 \cdot I_3+V_{BE3} \tag{14}$$

It is seen from the equation (14) that, by diminishing the resistance value of the resistor R1, the reference voltage $V_{REF}$, output from the differential amplifier A1, becomes smaller. That is, the reference voltage $V_{REF}$ equal to or smaller than 1.2V may be output.

A second embodiment of the present invention will now be described. FIG. 4 shows the configuration of the second embodiment of the present invention. In the present embodiment, the collector terminals of two BJTs Q1 and Q2 which have the ratio of the emitter sizes of 1:N, are connected to the differential input terminals of a differential amplifier A1. The bases of the BJTs Q1 and Q2 are connected to the output of the differential amplifier A1 to form a feedback loop, and a resistor R2, having one end connected to the ground potential, is connected to the emitter of the BJT Q2 to cause the PTAT current to flow through the bases and the collectors of the BJTs Q1 and Q2. The voltage obtained on voltage division of the base-to-emitter voltage $V_{BE}$ of the BJT Q1, and the voltage obtained on causing the PTAT current to flow through the resistor R0 which is smaller in resistance value than the resistor R1, are synthesized together. By so doing, the temperature dependency may be canceled with a voltage lower than the band-gap voltage (1.2V) of the related art, as the $V_{OS}$ dependency is maintained at a lower value.

That the collector currents $I_1$ and $I_2$ of the BJTs Q1 and Q2 become the PTAT currents may be demonstrated as follows:

$$V_{BE} = V_{BE1} = V_{BE2} + R_2 I_2' = V_{BE2} + R_2 \frac{I_2}{\alpha} \tag{15}$$

$$V_{BE1} - V_{BE2} = \frac{kT}{q}\ln\left(\frac{NI_1}{I_2}\right) = R_2\frac{I_2}{\alpha}$$

$$\begin{aligned} \therefore I_2 &= \alpha\frac{kT}{R_2 q}\ln\left(\frac{NI_1}{I_2}\right)\Big|_{V_{OS}\to 0} \\ &= \alpha\frac{kT}{R_2 q}\ln(N) \\ &= I_1 \\ &= I_3, (\therefore V_{BE1} = V_{BE3}) \end{aligned}$$

where $\alpha$ is the current amplification factor of the BJT Q2 ($I_2=\alpha I_2'$).

It is apparent that, if, in the above equation (3), both the base-to-emitter voltage $V_{BE1}$ of the BJT Q1 and the resistance of the resistor R1 are multiplied by a coefficient m ($0<m<1$), the output voltage becomes equal to a smaller value of $m\times V_{REF}$, however, the characteristic that the output voltage is free of temperature dependency may be maintained unaffected.

The present embodiment is based on this principle. That is, a divided voltage of the base-to-emitter voltage $V_{BE}$ is generated by the resistors R3 and R4.

On the other hand, a BJT Q3 is provided newly and the base of this BJT Q3 is connected to the bases of the BJTs Q1 and Q2 to constitute a current mirror. By this configuration, a PTAT current $I_3$ flows through the BJT Q3.

In the present embodiment, a differential amplifier A2 is added, as shown in FIG. 4. This differential amplifier A2 has its non-inverting terminal (+) connected to a connection node of the resistors R3 and R4, so as to be supplied with a divided voltage of the base-to-emitter voltage $V_{BE}$ ($V_{BE}\times R4(R3+R4)$) while having its output connected via resistor R0 to the collector of the BJT Q3. With this configuration, the voltage at the collector of the BJT Q3, connected to the inverting input terminal of the differential amplifier A2, is the divided voltage of the base-to-emitter voltage $V_{BE}$.

Since the PTAT current $I_3$ flows through the collector of the BJT Q3, the PTAT current $I_3$ flows through the resistor R0 as well. In case the resistance value of the resistor R0 is such a value obtained on multiplying a resistance value, which is capable of canceling the temperature dependency without dividing the base-to-emitter voltage $V_{BE}$, with a coefficient which is the same as the voltage dividing ratio ($=\{R4/(R3+R4\}$), it is possible to obtain the reference voltage $V_{REF}$ lower than that of the conventional circuit and which does not suffer the temperature dependency.

The output terminal of the differential amplifier A2 is connected to one end of the resistor R1 of the PTAT current generating section as well. Since the output voltage of the differential amplifier A2 is not dependent on the external voltage nor on the temperature, it is possible to acquire the stable PTAT current.

A third embodiment of the present invention will now be described. FIG. 5 shows the configuration of the third embodiment of the present invention. It is noted that, in the present embodiment, MOS transistors are used for generating the PTAT current and the reference voltage.

The threshold voltage $V_T$ of the MOS transistor may be set so as to be lower than the base-to-emitter voltage $V_{BE}$ of the BJT, so that, with the present embodiment, it is possible to generate the output voltage $V_{REF}$ which is lower in level than with the constitution employing the BJT.

Referring to FIG. 5, the present embodiment includes three resistors (two resistors R1 and one resistor R2), MOS transistors M1 and M2, having a channel width ratio set to 1:N, and a differential amplifier A1.

The N-channel MOS transistor M1 is connected in a diode configuration and has its drain and gate terminals to the non-inverting input terminal (+) of the differential amplifier A1. The drain terminal of the N-channel MOS transistor M2 is connected to the inverting input terminal (−) of the differential amplifier A1, while the gate of the MOS transistor M2 is connected to the drain and gate terminals of the MOS transistor M1. The source terminal of the MOS transistor M2 is connected to one end of the resistor R2. The other end of the resistor R2 is connected to the ground potential. The drain terminals of the MOS transistors M1 and M2 are connected to one ends of the resistors R1, R1, the one ends of which are connected in common to the output terminal of the differential amplifier A1.

When the MOS transistor is operated in a weak inversion region, or in a sub-threshold region, the relationship of the following equation (16):

$$I_D = I_{D0}\exp\left(\frac{qV_{GS}}{nkT}\right) \tag{16}$$

which is similar to the relationship between the base-to-emitter voltage and the collector current of the BJT, holds between the gate-to-source voltage and the drain current.

In the above equation, n denotes a process-dependent constant which ordinarily assumes a value of 1 to 2.

Thus, when the constitution as shown in FIG. 5 is used, the PTAT current $I_1$ (=12) flows through the resistor R1, as in the case of using the BJT. The voltage difference between the gate-to-source voltages of the MOS transistors M1 and M2, that is, $\Delta V_{GS}=V_{GS1}-V_{GS2}$, is represented by the following equation (17):

$$\Delta V_{GS} = \frac{kT}{q}\ln N \tag{17}$$

where n=1, so that $I_1$ (=12) may be represented by the following equation (18).

$$I_2 = \frac{\Delta V_{GS}}{R_2} = \frac{kT}{R_2 q}\ln N = I_1 \tag{18}$$

On the other hand, the threshold voltage $V_T$ of the MOS transistor has substantially the same temperature dependency as that of the base-to-emitter voltage $V_{BE}$ of the BJT.

Thus, by setting the threshold voltage $V_T$ of the MOS transistor so as to be lower than the base-to-emitter voltage $V_{BE}$ of the BJT, the temperature dependency may be canceled with an output voltage $V_{REF}$ which is lower than when the BJT is used. This is obvious from the fact that the following equation (19):

$$V_{REF}=V_T(M_1)+I_1R_1 \tag{19}$$

holds in the circuit of the present embodiment.

It is seen from the equation (19) that, since the first term and the second term of the equation exhibit positive temperature dependency and negative temperature dependency, respectively, such temperature dependency may be canceled by adjusting the resistance of the resistor R1 appropriately.

In the present embodiment, the dependency of the output voltage (output reference voltage $V_{REF}$) on the input offset voltage of the differential amplifier is of the same order of magnitude as that of the first and second embodiments described with reference to FIGS. 3 and 4.

The reason therefor is that, as in the above-described first and second embodiments, slight changes (changes of the order of magnitude of $V_{OS}$) give rise to changes in the drain current of the MOS transistor $M_2$, due to the action of amplification of the MOS transistor $M_2$, thus causing marked changes in its drain voltage through R1.

The circuit configuration of the present embodiment may be said to be not suited to an application where high accuracy in particular is required, because variations of the order of 50 mV to 100 mV of the absolute value of the threshold voltage $V_T$ of the MOS transistor, attendant on process variations, directly translate themselves into the output voltage (output reference voltage). However, since the number of elements is small, while there is no large-sized junction area, such as N-well or P-well, the circuit configuration has small leakage current and hence may be suited to an application where it is necessary to reduce the current consumption to 1 microampere or less.

Figure 8:
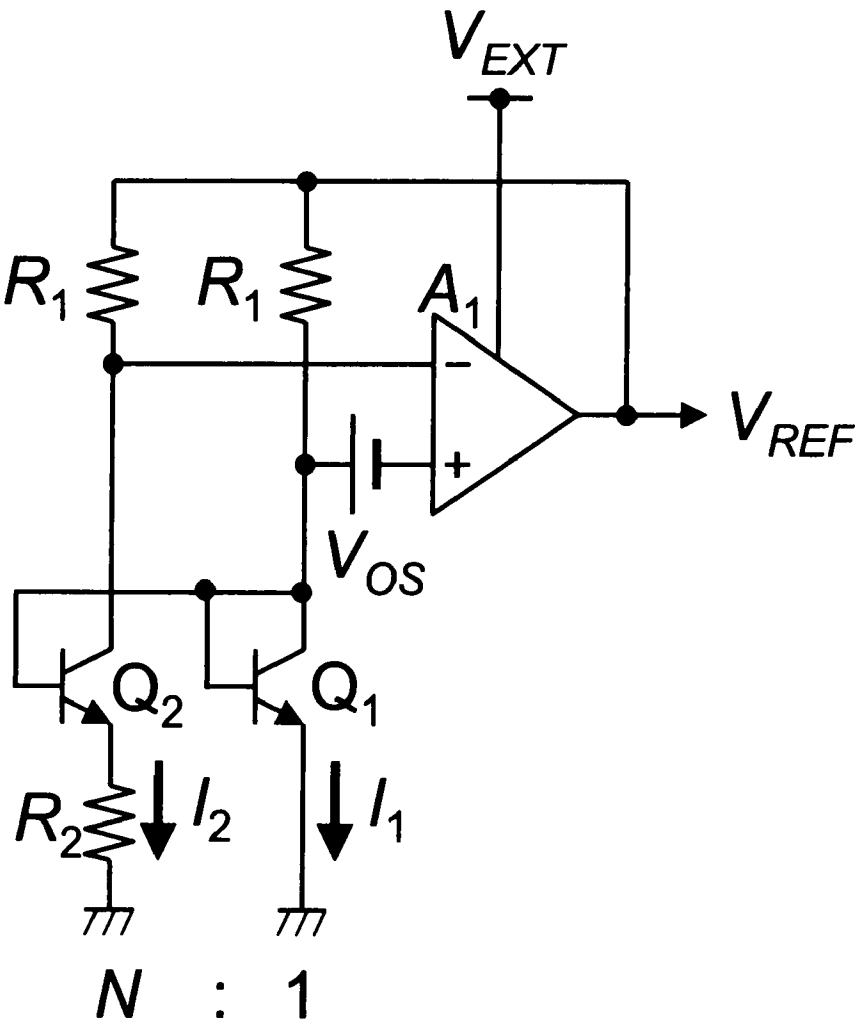
FIG. 8 is a circuit diagram showing the configuration of a fourth embodiment of the present invention.

A fourth embodiment of the present invention will now be described. FIG. 8 shows the configuration of the fourth embodiment of the present invention. The present embodiment corresponds to the configuration of FIG. 5 where the N-channel MOS transistors are replaced by BJTs.

In the present embodiment, the output voltage $V_{REF}$ is of substantially the same order of magnitude as that of the constitution shown in FIG. 2. However, the present embodiment has a merit that the layout area may be reduced in an amount corresponding to the decreased number of the elements.

Since the base currents of the BJTs Q1 and Q2 need to be supplied via resistor $R_1$, it may be an occurrence that the current density ratio of the BJTs Q1 and Q2 deviates from 1:N such that an accurate band-gap voltage cannot be output. Hence, the present embodiment may be said to be proper to an application where certain accuracy is needed but the device area is desirably to be reduced.

Figure 9:
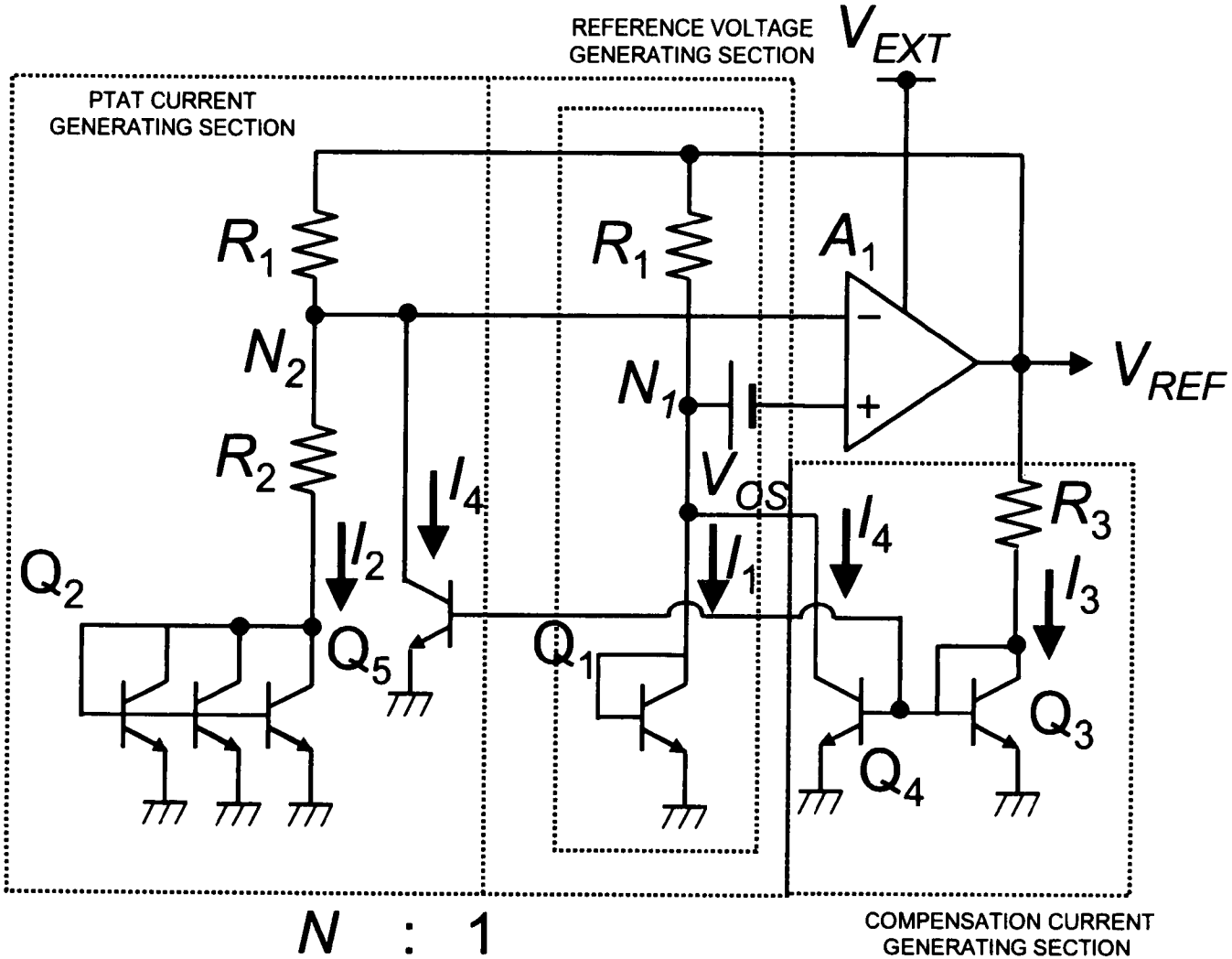
FIG. 9 is a circuit diagram showing the configuration of a reference example.

A reference example of the present invention will now be described. FIG. 9 shows the configuration of a reference example of the present invention. The configuration of this reference example corresponds to the configuration of FIG. 1 to which has been added the compensation current generating section of the present invention explained with reference to FIG. 3. Although the transistors Q1 and Q2 shown in FIG. 9 are NPN BJTs, these transistors may, of course, be PNP BJTs, as in FIG. 1.

Referring to FIG. 9, the compensation current generating section includes a resistor R3, having one end connected to an output end of the differential amplifier A1, and BJTs Q3 and Q4. The BJT Q3 has an emitter grounded, while having a base and a collector connected to the other end of the resistor R3. The BJT Q4 has an emitter grounded, while having a collector connected, along with the collector of the BJT Q1, to the node N1, and having a base connected to the base of a BJT Q3. The compensation current generating section also includes a BJT Q5 having an emitter grounded, having a collector connected, along with the collector of the BJT Q2, to the node N2, and having a base connected to the base of the BJT Q3. The current $I_3$ is $(V_{REF}-V_{BE3})/R3$ and has a positive temperature coefficient, as described above. The sum current of a mirror current $I_4$ of the current $I_3$ and the collector current (PTAT current) $I_1$ of the BJT Q1 flows through the resistor R1, connected between the node N1 and the output terminal of the differential amplifier A1. The sum current of the mirror current $I_4$ and the collector current (PTAT current) 12 of the BJT Q2 (sum current) flows through the resistor R1, connected between the node N2 and the output terminal of the differential amplifier A1.

Figure 1:
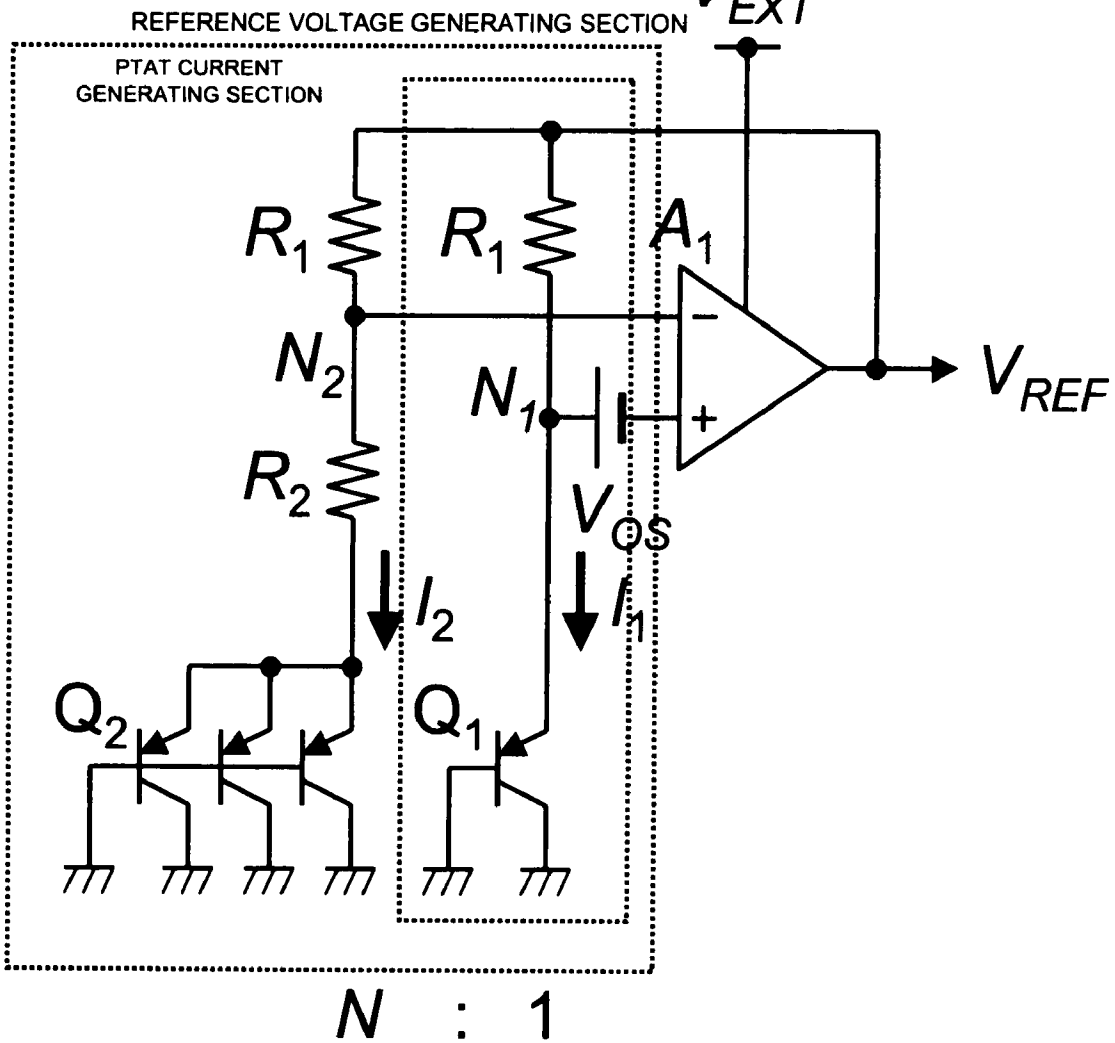
FIG.1 RELATED ART
FIG. 1 is a circuit diagram showing an example of the configuration of a conventional reference voltage circuit.

In the circuit of the reference example of FIG. 9, in which the current, obtained on adding the current $I_4$ of the positive temperature coefficient, generated in the compensation current generating section, and the PTAT current $I_1$ (or 12), is caused to flow through the resistor R1, the resistance value of the resistor R1 may be reduced and the output voltage (output reference voltage) $V_{REF}$ may be lower than with the circuit of the related art shown in FIG. 1. In this case, the resistance of the resistor R1 or R2 is trimmed, such as with laser or electrical fuse, as described above. Or, an offset adjustment function, for example, is added to the differential amplifier, whereby the reference voltage $V_{REF}$ lower than e.g. 1.26V may be output.

The present invention, described above with reference to the preferred embodiments thereof, may be applied to, for example, a large variety of integrated circuits, such as memories, logic circuits or analog integrated circuits, operating at a voltage lower than the power supply voltage of 1.5V or lower.

Although the present invention has so far been explained with reference to the preferred embodiments, the present invention is not limited to the particular configurations of these embodiments. It will be appreciated that the present invention may encompass various changes or corrections such as may readily be arrived at by those skilled in the art within the scope and the principle of the invention.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A reference voltage generating circuit comprising:

a current generating section that generates a first current having a positive temperature coefficient;

a voltage generating section that generates a voltage having a negative temperature coefficient;

a voltage dividing circuit that divides said voltage of the negative temperature coefficient, generated by said voltage generating section; and a synthesis section that generates a voltage which is the sum of a terminal voltage obtained on causing said first current through a resistor and a voltage obtained on dividing said voltage having the negative temperature coefficient by said voltage dividing circuit, and for outputting the sum voltage generated as a reference voltage.

2. The reference voltage generating circuit according to claim 1, wherein said synthesis section comprises a differential amplifier;

wherein said current generating section comprises:

a first resistor having one end connected to an output terminal of said differential amplifier;

a first transistor having a collector connected to the other end of said first resistor and having an emitter connected to the ground potential;

a second resistor having one end connected to an output terminal of said differential amplifier; and a second transistor having a collector connected to the other end of said second resistor and having an emitter connected via a third resistor to the ground potential;

wherein said voltage generating section comprises:

a fourth resistor having one end connected to said output terminal of said differential amplifier; and a third transistor having a collector connected to the other end of said fourth resistor and having an emitter connected to the ground potential; and wherein said reference voltage generating circuit further comprises:

another differential amplifier having a non-inverting input terminal and an inverting input terminal connected to connection nodes of said first and second resistors and collectors of said first and second transistors, respectively, said another differential amplifier having an output terminal connected to a base of said third transistor;

said first to third transistors having bases connected in common; and a voltage dividing circuit connected between the common base of said first to third transistors and the ground, said voltage dividing circuit dividing the base-to-emitter voltage;

an output voltage obtained on voltage division by said voltage dividing circuit being supplied to a non-inverting input terminal of said differential amplifier; a connection node of said fourth resistor and the collector of said third transistor being connected to an inverting input terminal of said differential amplifier.

3. The reference voltage generating circuit according to claim 2, wherein the resistances of said first and second resistors of said current generating section correspond to a product of resistances for a case where the temperature dependency is compensated without dividing the base-to-emitter voltage with a voltage division ratio of said voltage dividing circuit.

4. The reference voltage generating circuit according to claim 2, wherein, in said current generating section, the ratio of the emitter sizes of said first and second transistors is 1:N, where N is an integer greater than 1.

5. The reference voltage generating circuit according to claim 2, wherein said differential amplifier comprises a differential input stage and an output stage for receiving an output of said differential input stage to drive an output terminal;

said differential input stage comprising:

a differential pair including a pair of MOS transistors having commonly coupled sources and having gates connected to a non-inverting input terminal and to an inverting input terminal respectively;

a current source connected between coupled sources of said differential pair and the ground and supplying a current to said differential pair; and a load circuit connected between the drains of said MOS transistors of said differential pair and a power supply.

6. The reference voltage generating circuit according to claim 1, wherein said voltage having the negative temperature coefficient corresponds to the base-to-emitter voltage of a bipolar transistor.

7. The reference voltage generating circuit according to claim 1, wherein said first current with the positive temperature coefficient is the current proportional to a thermal voltage (=kT/q, where k is the Boltzmann constant, T is absolute temperature and q is the electrical charge of an electron).

8. The reference voltage generating circuit according to claim 1, wherein said synthesis section comprises a differential amplifier;

wherein said current generating section comprises:

a first resistor having one end connected to an output terminal of said differential amplifier;

a first transistor having a collector connected to the other end of said first resistor and having an emitter connected to the ground potential;

a second resistor having one end connected to an output terminal of said differential amplifier; and a second transistor having a collector connected to the other end of said second resistor and having an emitter connected via a third resistor to the ground potential.

9. The reference voltage generating circuit according to claim 8, wherein said voltage generating section comprises:

a fourth resistor having one end connected to said output terminal of said differential amplifier; and a third transistor having a collector connected to the other end of said fourth resistor and having an emitter connected to the ground potential.

10. The reference voltage generating circuit according to claim 8, wherein the resistances of said first and second resistors of said current generating section correspond to a product of resistances for a case where the temperature dependency is compensated without dividing the base-to-emitter voltage with a voltage division ratio of said voltage dividing circuit.

11. The reference voltage generating circuit according to claim 8, wherein, in said current generating section, the ratio of the emitter sizes of said first and second transistors is 1:N, where N is an integer greater than 1.

12. The reference voltage generating circuit according to claim 8, wherein said differential amplifier comprises a differential input stage and an output stage for receiving an output of said differential input stage to drive an output terminal;

said differential input stage comprising:

a differential pair including a pair of MOS transistors having commonly coupled sources and having gates connected to a non-inverting input terminal and to an inverting input terminal respectively;

a current source connected between coupled sources of said differential pair and the ground and supplying a current to said differential pair; and a load circuit connected between the drains of said MOS transistors of said differential pair and a power supply.

* * * * *